US011171409B2

(12) United States Patent
Chen et al.

(10) Patent No.: US 11,171,409 B2
(45) Date of Patent: Nov. 9, 2021

(54) MOBILE DEVICE

(71) Applicant: WISTRON NEWEB CORPORATION, Hsinchu (TW)

(72) Inventors: Ching-Wen Chen, Hsinchu (TW); Chia-Hao Chang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 17/013,935

(22) Filed: Sep. 8, 2020

(65) Prior Publication Data

US 2021/0226318 A1 Jul. 22, 2021

(30) Foreign Application Priority Data

Jan. 16, 2020 (TW) ..... 109101573

(51) Int. Cl.
*H01Q 1/24* (2006.01)
*H01Q 1/22* (2006.01)

(52) U.S. Cl.
CPC ..... *H01Q 1/243* (2013.01); *H01Q 1/2283* (2013.01)

(58) Field of Classification Search
CPC ..... H01Q 1/24; H01Q 1/241; H01Q 1/243; H01Q 1/22; H01Q 1/2283; H01Q 5/30; H01Q 5/35; H01Q 15/002; H01Q 15/006
See application file for complete search history.

(56) References Cited

U.S. PATENT DOCUMENTS

| | | | | |
|---|---|---|---|---|
| 10,297,907 | B2 | 5/2019 | Chen et al. | |
| 2012/0013511 | A1* | 1/2012 | Sumi | H01Q 1/243 343/702 |
| 2013/0135157 | A1* | 5/2013 | Tsou | H01Q 1/52 343/702 |
| 2018/0212304 | A1* | 7/2018 | Peng | H01Q 9/38 |
| 2019/0123441 | A1* | 4/2019 | Sudo | H01Q 1/521 |
| 2019/0221943 | A1* | 7/2019 | Wu | H01Q 13/106 |

* cited by examiner

*Primary Examiner* — Thai Pham
(74) *Attorney, Agent, or Firm* — McClure, Qualey & Rodack, LLP

(57) ABSTRACT

A mobile device including a metal housing, a substrate, a grounding metal element, a first radiation element, a second radiation element, and a switch element is provided. The metal housing includes a body portion and a slot disposed on the body portion. The substrate is disposed on the metal housing. The grounding metal element is disposed on the metal housing and coupled to the metal housing. The switch element is disposed on the substrate, and the switch element is coupled between the second radiation element and the grounding metal element. When the switching element is switched to a first mode, a first radiation pattern is generated by the first radiation element and the second radiation element, when the switching element is switched to a second mode, a second radiation pattern is generated by the first radiation element and the second radiation element.

17 Claims, 16 Drawing Sheets

MOBILE DEVICE

CROSS-REFERENCE TO RELATED PATENT APPLICATION

This application claims the benefit of priority to Taiwan Patent Application No. 109101573, filed on Jan. 16, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a mobile device, and more particularly to a mobile device having an antenna structure.

BACKGROUND OF THE DISCLOSURE

In the related art, it is common to have a housing of a mobile device be made of metal materials for the purposes of aesthetic appearance and robustness. However, an antenna integrated in the mobile device is prone to be influenced by the housing due to the characteristics of metal, which decreases the communication quality of the mobile device.

Therefore, how the communication quality of the mobile device can be improved by modifying mechanical designs of the mobile device has become a critical issue in the industry.

SUMMARY OF THE DISCLOSURE

In response to the above-referenced technical inadequacies, the present disclosure provides a mobile device having an antenna structure.

In one aspect, the present disclosure provides a mobile device. The mobile device includes a metal housing, a substrate, a grounding metal element, a first radiation element, a second radiation element and a switch element. The metal housing includes a body portion and a slot disposed on the body portion. A substrate is disposed on the metal housing. A grounding metal element is disposed on the substrate and coupled to the metal housing. The first radiation element includes a feeding portion, and the first radiation element includes a first feeding branch, a second feeding branch and a third feeding branch, in which a vertical projection of the first radiation element onto the metal housing at least partially overlaps a vertical projection of the slot. An end of the first feeding branch is coupled to the feeding portion, and the first feeding branch includes a first polygon, the first polygon including at least a long axis and a short axis, and the long axis of the first polygon extending along a first direction. An end of the second feeding branch is coupled to the feeding portion, the second feeding branch includes a second polygon, and the second polygon includes at least a long axis and a short axis, the long axis of the second polygon extending along a second direction, and the second direction being opposite to the first direction. An end of the third feeding branch is coupled to the feeding portion, the third feeding branch includes a third polygon, the third polygon includes at least a long axis and a short axis, and the long axis of the third polygon extends along the first direction. The second radiation element is disposed on the substrate, a vertical projection of the second radiation element onto the metal housing at least partially overlaps the vertical projection of the slot. The switch element is disposed on the substrate and coupled between the second radiation element and the grounding metal element. A first radiation pattern is generated by the first radiation element and the second radiation element when the switch element is switched to a first mode, and a second radiation pattern is generated by the first radiation element and the second radiation element when the switch element is switched to a second mode.

Therefore, by virtue of "coupling the switch element between the second radiation element and the grounding metal element" and "generating a first radiation pattern by the first radiation element and the second radiation element when the switch element is switched to a first mode, and generating a second radiation pattern by the first radiation element and the second radiation element when the switch element is switched to a second mode", at least one of the radiation pattern and the return loss of the mobile device may be adjusted.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
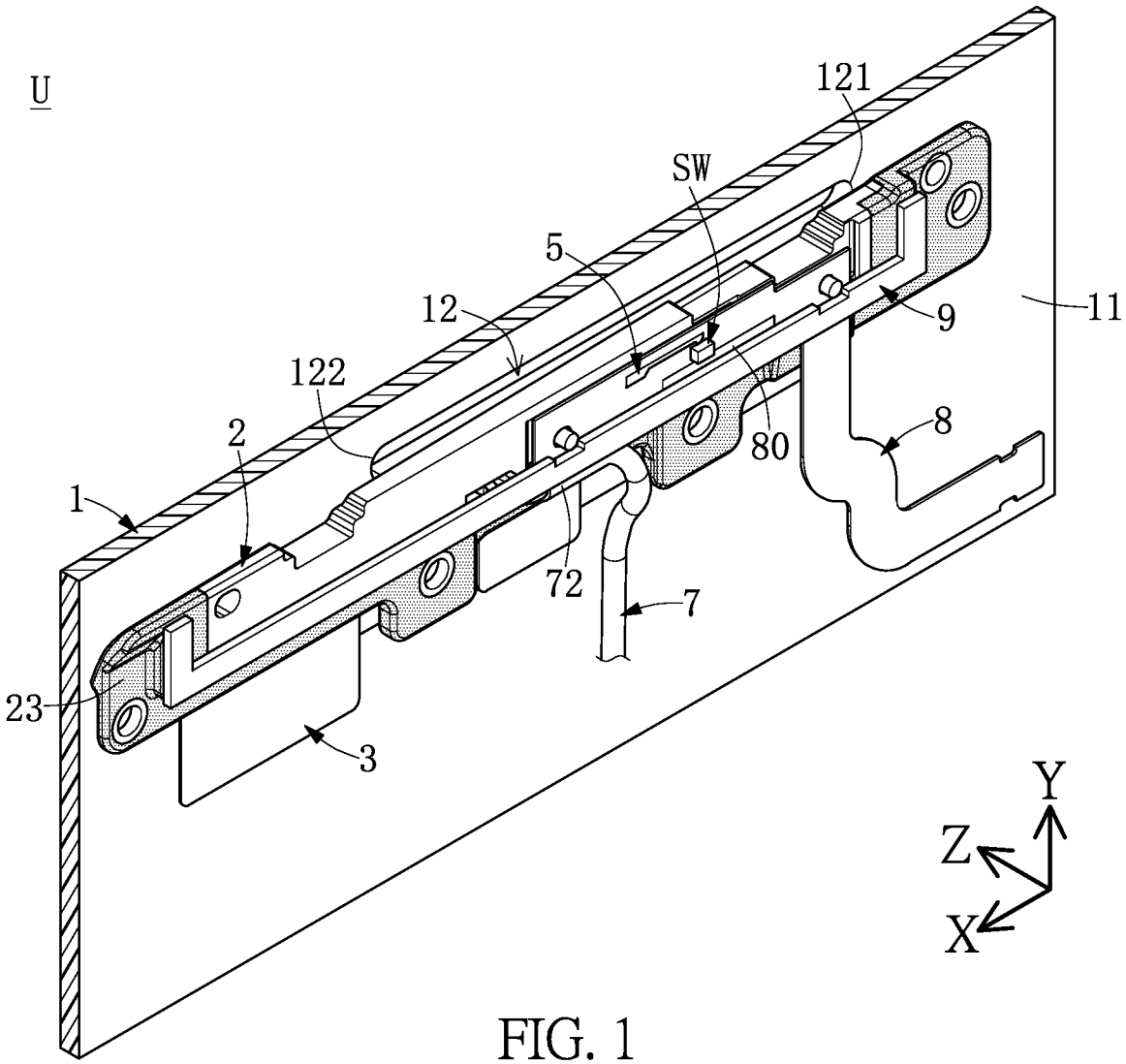
FIG. 1 illustrates an assembled perspective view of a mobile device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
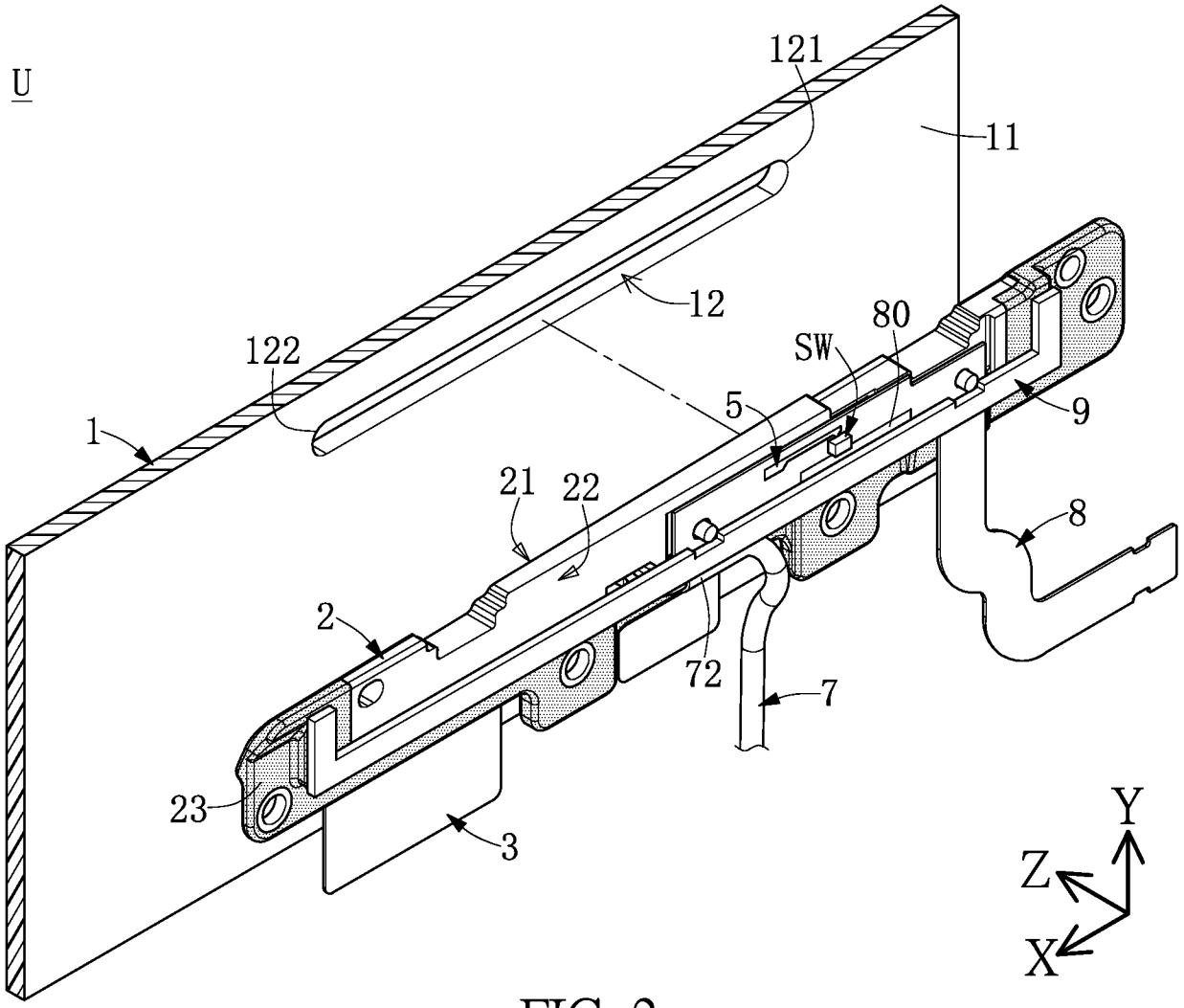
FIG. 2 illustrates an exploded perspective view of the mobile device according to the first embodiment of the present disclosure.
Figure 3:
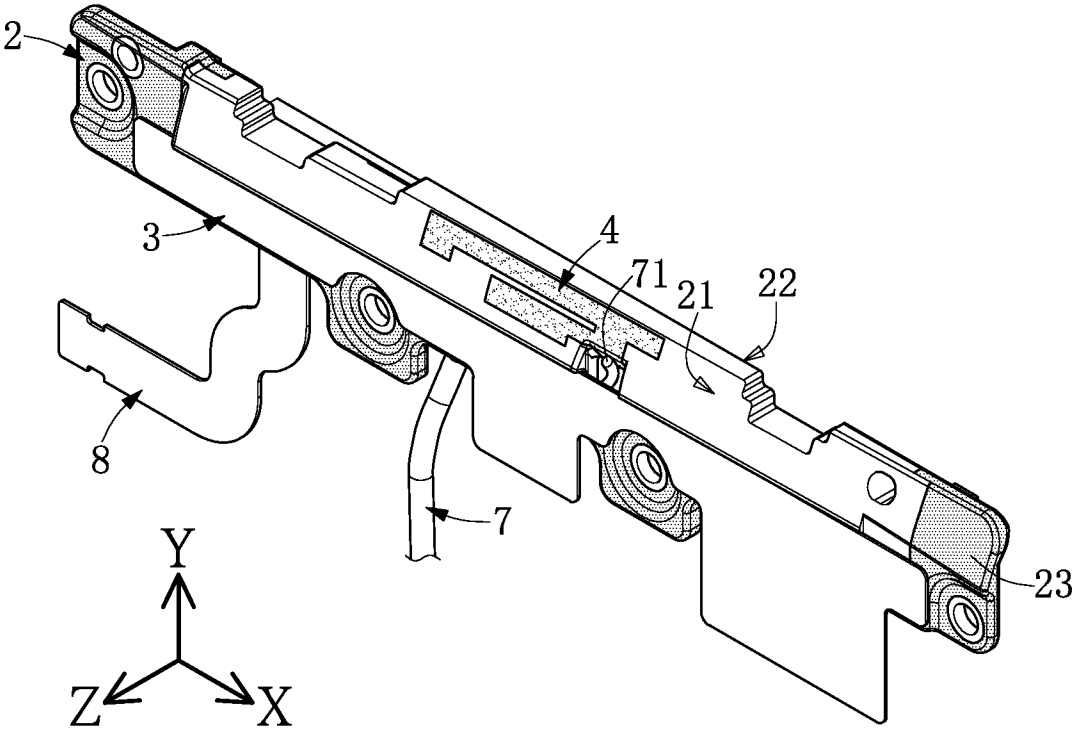
FIG. 3 illustrates another exploded perspective view of the mobile device according to the first embodiment of the present disclosure.
Figure 4:
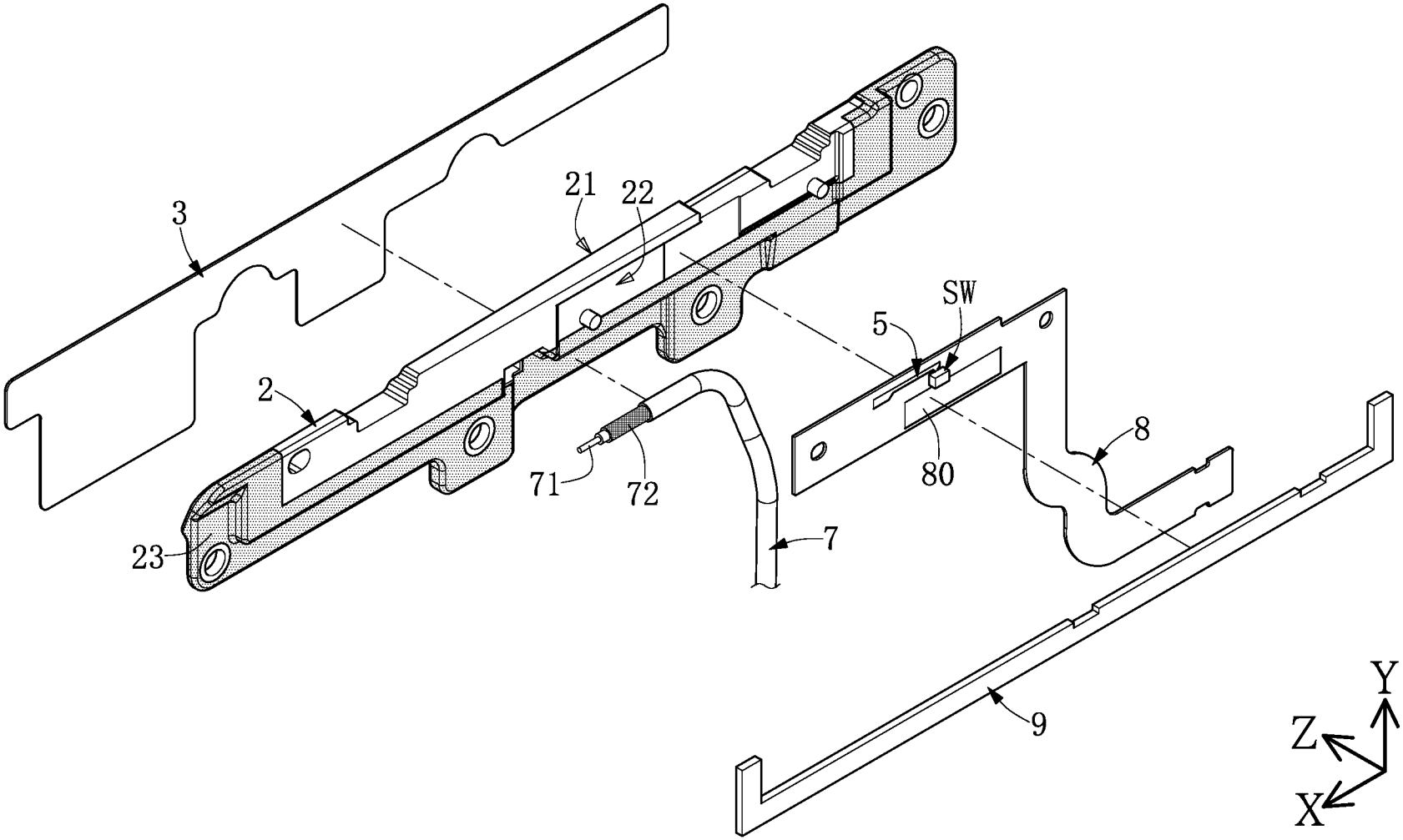
FIG. 4 illustrates still another exploded perspective view of the mobile device according to the first embodiment of the present disclosure.
Figure 5:
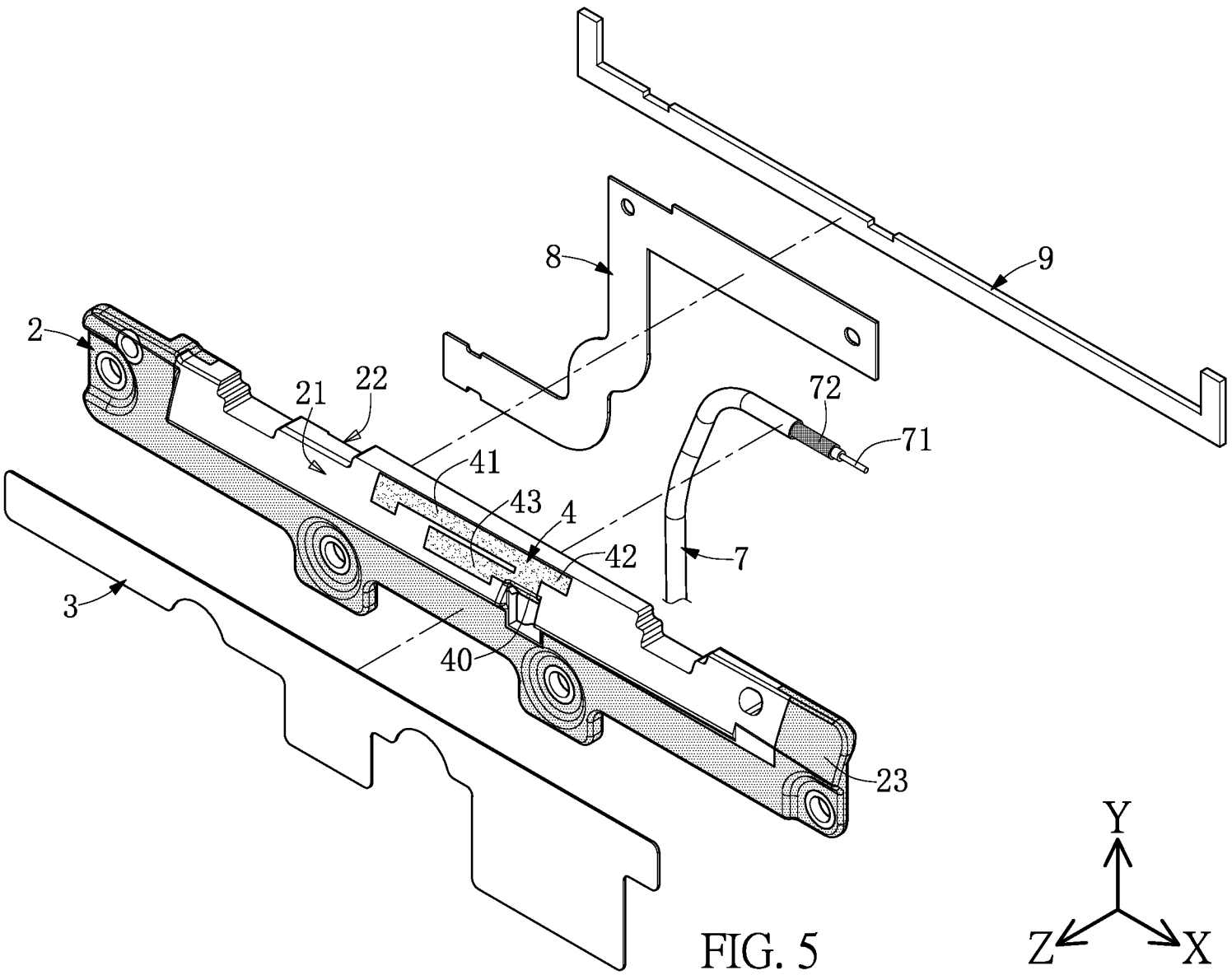
FIG. 5 illustrates yet another exploded perspective view of the mobile device according to the first embodiment of the present disclosure.

Referring to FIG. 1 to FIG. 5, FIG. 1 illustrates an assembled perspective view of a mobile device according to a first embodiment of the present disclosure. FIG. 2, FIG. 4 and FIG. 5 illustrate exploded perspective views of the mobile device according to the first embodiment of the present disclosure, respectively. In addition, there is a component (metal housing 1) not shown in FIG. 3 in order to present a portion of components of the mobile device. The present disclosure provides a mobile device U, and the mobile device U may be a smart phone, a tablet computer or a notebook computer, but the present disclosure is not limited thereto. In addition, The mobile device U provided by the present disclosure includes an antenna structure (the antenna structure may include a metal housing 1, a slot 12, a grounding metal element 3, a first radiation element 4, a second radiation element 5 and a switch element SW), in order to transmit and receive RF (radio frequency) signals. The mobile device U may generate a first operating band and a second operating band, and a center frequency of the second operating band is greater than a center frequency of the first operating band. For example, the mobile device U may generate the first operating band ranging from 2400 MHz to 2500 MHz and the second operating band ranging from 5150 MHz to 5875 MHz, but the present disclosure is not limited thereto.

The mobile device U includes a metal housing 1, a substrate 2, a grounding metal element 3, a first radiation element 4, a second radiation element 5 and a switch element SW. For example, the metal housing 1 may be a metal cover of the mobile device U, the grounding metal element 3, the first radiation element 4, the second radiation element 5 and the switch element SW may be disposed on the substrate 2, and the substrate 2 may be disposed on the metal housing 1 or adjacent to the metal housing 1, but the present disclosure is not limited thereto. In addition, in one embodiment, a plurality of holes (not marked in FIG. 1) may be formed on the substrate 2, such that the substrate 2 may be fixed on the metal housing 1 by inserting a plurality of fixing elements (not shown in FIG. 1) into the plurality of holes. In addition, while some components are not shown in FIG. 1, in practice, the mobile device U may further include, but not being limited to, the following components: a processor, a touch control panel, a speaker, a battery module and a housing part. In addition, the term "adjacent" in the present disclosure refers to a gap between two elements that is substantially smaller than a certain distance (for example, but not limited to, 5 millimeters or a distance shorter than 5 millimeters), and the term "adjacent" may also refer to a direct contact between two elements (i.e., the distance between two elements may be 0 millimeters).

The metal housing 1 includes a body portion 11 and a slot 12 disposed on the body portion 11; for example, the slot 12 may substantially be a bar-shaped opening or a rectangular opening. In the present disclosure, the slot 12 is a closed slot and has a rectangular shape, and two closed ends 121 and 122 of the slot 12 are formed opposite to each other. However, in another embodiment, the slot 12 may be a monopole slot having an opening end and closed end that are formed opposite to each other. In the present disclosure, the antenna structure may include the metal housing 1, the slot 12, the grounding metal element 3, the first radiation element 4, the second radiation element 5, and the switch element SW.

In addition, for example, the substrate 2 may be an FR4 (flame retardant 4) substrate, a PCB (printed circuit board) or an FPCB (flexible printed circuit board), but the present disclosure is not limited thereto. In addition, for example, the first radiation element 4 and the second radiation element 5 may be made of a metal sheet, a metal wire, or any other electrically conductive materials such as: copper, silver, aluminum, iron, or alloys thereof, but the present disclosure is not limited thereto. In addition, for example, the first radiation element 4 and the second radiation element 5 of the present disclosure may be formed on the substrate 2 by LDS (laser-direct-structuring) technology; however, in other embodiments, the first radiation element 4 and the second radiation element 5 may be a metal layer of a multi-layered board, but the present disclosure is not limited thereto.

Figure 6:
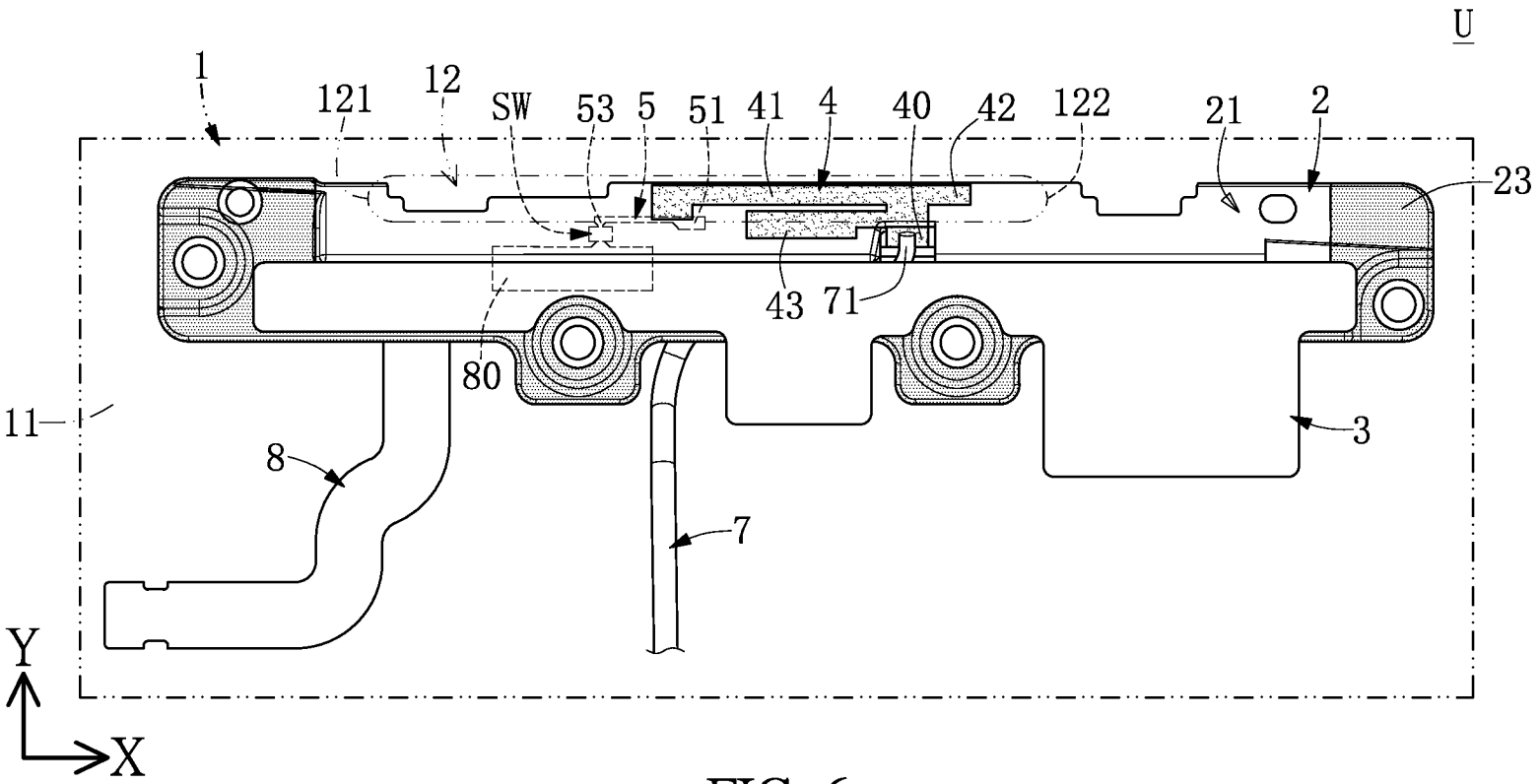
FIG. 6 illustrates a front view of the mobile device according to the first embodiment of the present disclosure.

Reference is further made to FIG. 1 to FIG. 5 in conjunction with FIG. 6, in which FIG. 6 illustrates a front view of the mobile device according to the first embodiment of the present disclosure. In detail, the substrate 2 includes a first surface 21 and a second surface 22 corresponding to the first surface 21, the first radiation element 4 is disposed on the first surface 21, the second radiation element 5 and the switch element SW are disposed on the second surface 22; however, in other embodiments, the second radiation element 5 may be disposed on the first surface 21, but the present disclosure is not limited thereto. It should be noted that, in the present disclosure, a ground metal layer 23 may be coated to the substrate 2, and the ground metal layer 23 may be coated to at least one of the first surface 21 and second surface 22. In addition, the second surface 22 of the substrate 2 may be disposed adjacent to or abut on the metal housing 1, and the substrate 2 is disposed adjacent to the slot 12, such that the substrate 2 completely or nearly completely covers the slot 12 of the metal housing 1.

The grounding metal element 3 is disposed on at least one of the first surface 21 and the second surface 22 of the substrate 2 and coupled to the body portion 11 of the metal housing 1, and the grounding metal element 3 and the metal housing 1 may provide a ground voltage level to the mobile device U. It should be noted that, disposing the grounding metal element 3 on the first surface 21 of the substrate 2 and coupling the grounding metal element 3 to the metal housing 1 are taken as an example in the present disclosure, and those skilled in the art may make modifications and alterations according to practical requirements. For example, in the present disclosure, the grounding metal element 3 may be coupled between the ground metal layer 23 and the metal housing 1; however, in other embodiments, the ground metal layer 23 may be not reiterated herein. In addition, for example, the grounding metal element 3 may be a ground copper foil extending from the substrate 2 to the metal housing 1, but the present disclosure is not limited thereto.

The first radiation element 4 is disposed on the substrate 2 and includes a feeding portion 40, and the first radiation element 4 includes a first feeding branch 41, a second feeding branch 42, and a third feeding branch 43. The first feeding branch 41, the second feeding branch 42 and the third feeding branch 43 may form a Y-shaped structure surrounding the feeding portion 40. It should be noted that, a vertical projection of the first radiation element 4 onto the metal housing 1 at least partially overlaps a vertical projection of the slot 12 onto the metal housing 1. Namely, a portion of the vertical projection(s) of at least one of the first feeding branch 41, the second feeding branch 42 and the third feeding branch 43 onto the metal housing 1 overlaps the vertical projection of the slot 12 onto the metal housing 1. In addition, in the present disclosure, a vertical projection of the second radiation element 5 onto the metal housing 1 at least partially overlaps a vertical projection of the slot 12 onto the metal housing 1.

Further, the mobile device U further includes: a feeding element 7 coupled between the feeding portion 40 of the first radiation element 4 and the grounding metal element 3, so as to transmit and receive signal. For example, the feeding element 7 may be a coaxial cable, but the present disclosure is not limited thereto. In addition, the feeding element 7 may include a feeding end 71 and a grounding end 72, the feeding end 71 is coupled to the feeding portion 40 of the first radiation element 4, and the grounding end 72 is coupled to the grounding metal element 3. Further, in one embodiment, the grounding end 72 may be coupled to the ground metal layer 23 to be indirectly coupled to the grounding metal element 3 through the ground metal layer 23, but the present disclosure is not limited thereto.

Figure 7:
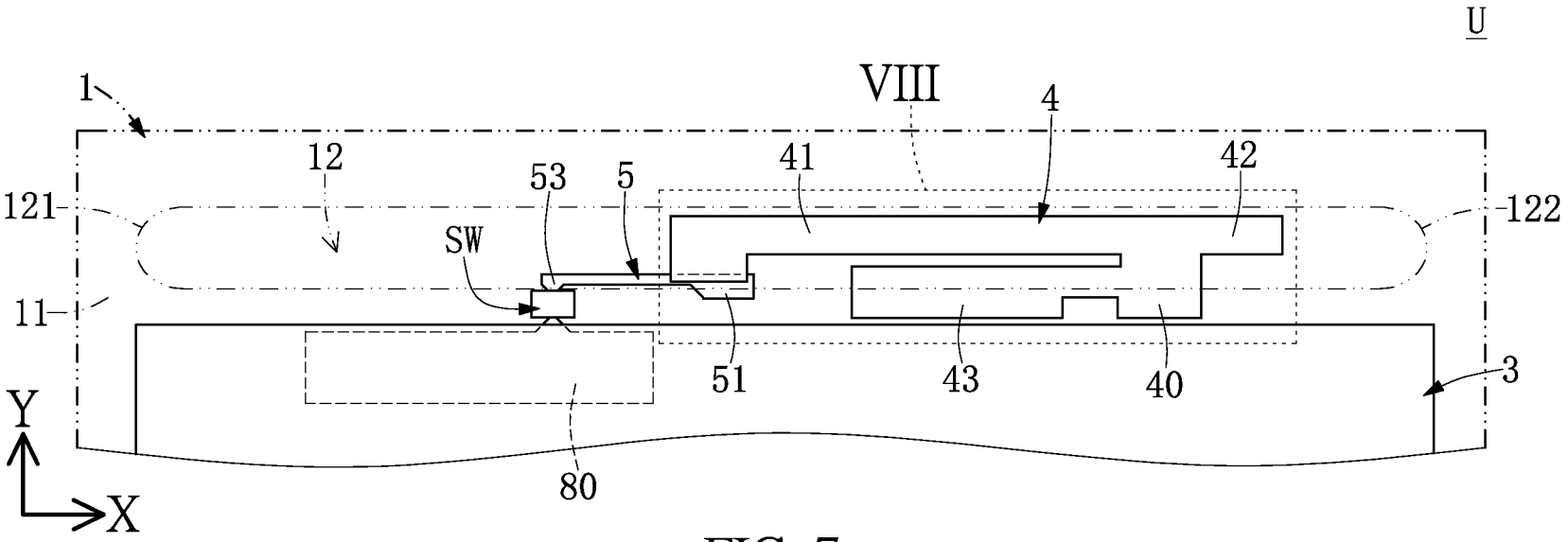
FIG. 7 illustrates another front view of the mobile device according to the first embodiment of the present disclosure.

Referring to FIG. 7, FIG. 7 illustrates another front view of the mobile device according to the first embodiment of the present disclosure. In order to clearly present the relative positions between the metal housing 1, the grounding metal element 3, the first radiation element 4, the second radiation element 5 and the switch element SW, the substrate 2 is not shown in FIG. 7. In detail, one end of the first feeding branch 41 is coupled to the feeding portion 40, and the first feeding branch 41 includes a first polygon substantially having a rectangular shape or an L-shape. One end of the first feeding branch 41 is coupled to the feeding portion 40, and another end of the first feeding branch 41 is an open end. The first polygon includes at least a long axis and a short axis, and the long axis of the first polygon is opposite to the feeding portion 40 and extends along a first direction (negative X direction). For example, the long axis of the first polygon may be a first dashed line passing through the open end and being parallel to the X axis. In addition, for example, the first feeding branch 41 and the slot 12 of the metal housing 1 are able to induce the first operating band. However, it should be noted that, the present disclosure is not limited to the abovementioned embodiment.

Moreover, one end of the second feeding branch 42 is coupled to the feeding portion 40, and the second feeding branch 42 includes a second polygon substantially having a rectangular shape or an L-shape. One end of the second feeding branch 42 is coupled to the feeding portion 40, and another end of the second feeding branch 42 is an open end. The second polygon includes at least a long axis and a short axis, the long axis of the second polygon is opposite to the feeding portion 40 and extends along a second direction (positive X direction), and the second direction is opposite to the first direction. For example, the long axis of the second polygon may be a second dashed line passing through the open end and being parallel to the X axis. In addition, for example, the second feeding branch 42 is able to induce the second operating band. However, it should be noted that, the present disclosure is not limited to the abovementioned embodiment.

In addition, one end of the third feeding branch 43 is coupled to the feeding portion 40, and the third feeding branch 43 includes a third polygon substantially having a rectangular shape, an L-shape or a U-shape. One end of the third feeding branch 43 is coupled to the feeding portion 40, and another end of the third feeding branch 43 is an open end. The third polygon includes a long axis and a short axis, and the long axis of the third polygon is opposite to the feeding portion 40 and extends along the first direction. For example, the long axis of the third polygon may be a third dashed line passing through the open end and being parallel to the X axis. In addition, for example, the third feeding branch 43 can be used to improve radiation efficiency and operating frequency bandwidth of the first operating band the second operating band. However, it should be noted that, the present disclosure is not limited to the abovementioned embodiment.

Further, at least a portion of each of the first feeding branch 41, the second feeding branch 42 and the third feeding branch 43 is parallel to the slot 12 of the metal housing 1. In some embodiments, a long axis (that passes through the two closed ends 121 and 122) of the slot 12, the long axis of the first feeding branch 41, the long axis of the second feeding branch 42 and the long axis of the third feeding branch 43 are parallel to each other. Further, there is a coupling effect induced between the first feeding branch 41 and the third feeding branch 43.

For example, a length of the slot 12 may substantially be equal to a half wavelength of the center frequency of the first operating band, a length of the first feeding branch 41 may substantially be equal to a quarter wavelength of the center frequency of the first operating band, a length of the second feeding branch 42 may substantially be equal to a quarter wavelength of the center frequency of the first operating band, and a length of the third feeding branch 43 may substantially be ranging from one-eighth wavelength to a quarter wavelength of the center frequency of the first operating band, but the present disclosure is not limited thereto.

Figure 8:
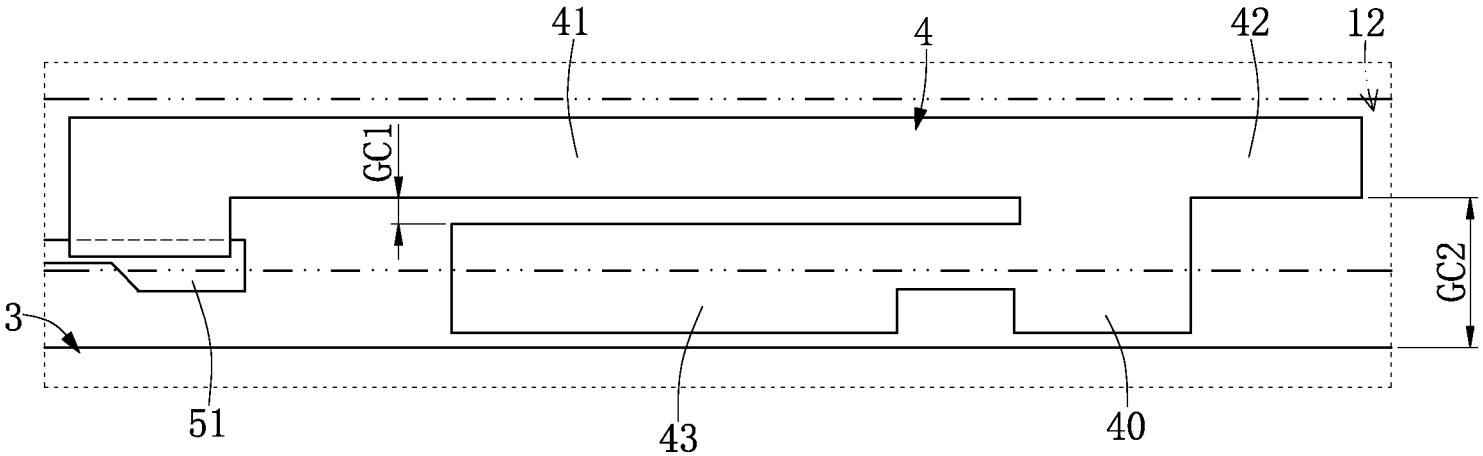
FIG. 8 illustrates a schematic enlarged view of section VIII in FIG. 7.

Reference is made to FIG. 8, which illustrates a schematic enlarged view of a section VIII in FIG. 7. In the present disclosure, a first coupling gap GC1 may be formed between the first feeding branch 41 and the third feeding branch 43, a coupling effect may be induced between the second feeding branch 42 and the grounding metal element 3, and a second coupling gap GC2 may be formed between the second feeding branch 42 and the grounding metal element 3. Taking the embodiment of FIG. 8 as an example, a width of the first coupling gap GC1 may be smaller than or equal to a width of the slot 12, and a width of the second coupling gap GC2 may be greater than or equal to the width of the slot 12, but the present disclosure is not limited thereto. With this structure, the present disclosure is able to adjust the width of the first coupling gap GC1 and the width of the second coupling gap GC2 in order to adjust the impedance matching of the first radiation element 4.

Figure 9:
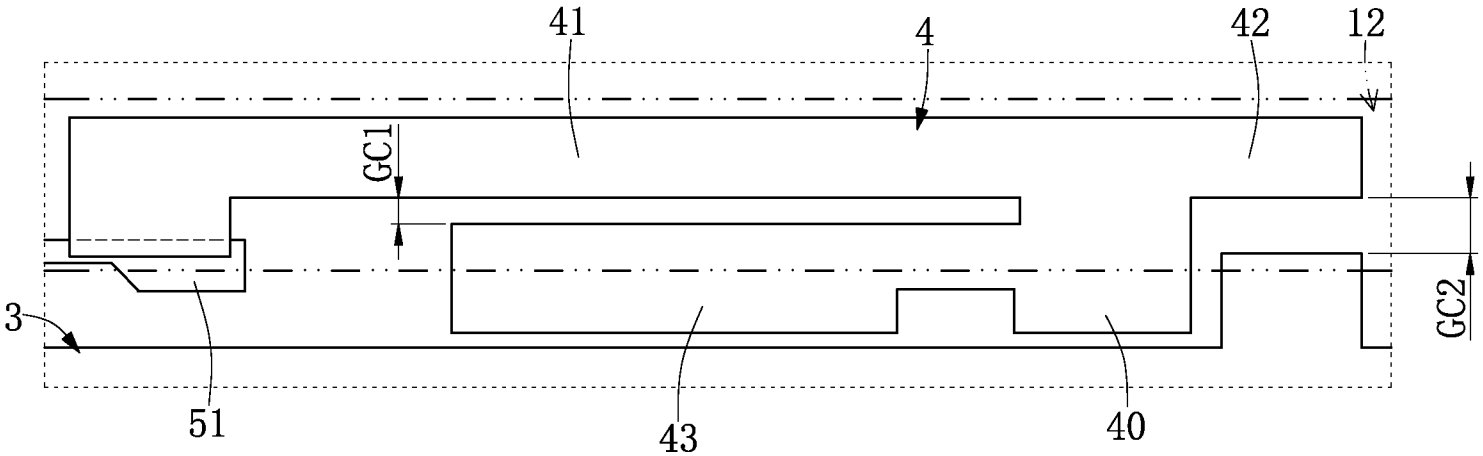
FIG. 9 illustrates a schematic diagram of another embodiment of FIG. 8.

Referring to FIG. 9, FIG. 9 illustrates a schematic diagram of another embodiment of FIG. 8. As can be learned by comparing FIG. 9 with FIG. 8, a difference between FIG. 9 and FIG. 8 is that, in the embodiment of FIG. 9, by adjusting the width of the second coupling gap GC2, the impedance matching between the second feeding branch 42 and the grounding metal element 3 is adjusted. In addition, in the embodiment of FIG. 9, the width of the second coupling gap GC2 may be smaller than or equal to the width of the slot 12, but the present disclosure is not limited thereto.

Reference is further made to FIG. 3, the mobile device U further includes a conductive blocking element 9, the conductive blocking element 9 may be disposed on the substrate 2 and coupled to the grounding metal element 3. In the present disclosure, the conductive blocking element 9 may be disposed on the second surface 22 of the substrate 2, and the conductive blocking element 9 may be coupled to the ground metal layer 23, such that the conductive blocking element 9 may be indirectly coupled to the grounding metal element 3 through the ground metal layer 23. However, in other embodiments, the conductive blocking element 9 may be disposed on the first surface 21 of the substrate 2, but the present disclosure is not limited thereto.

Moreover, a vertical projection (not marked in FIG. 2) of the conductive blocking element 9 onto the metal housing 1 may have a U-shape, and the vertical projections of the first radiation element 4 and the second radiation element onto the metal housing are within the U-shape vertical projection of the conductive blocking element 9. With this structure, the conductive blocking element 9 can be used to protect the first radiation element 4 and the second radiation element 5 from interferences caused by any electronic components of the mobile device U. Meanwhile, the conductive blocking element 9 can act as a reflection board that is able to centralize the radiation pattern of the antenna structure toward the slot 12. In addition, for example, the conductive blocking element 9 may be a conductive sponge, but the present disclosure is not limited thereto.

Further, it should be noted that, the term "coupled" in the present disclosure may refer to direct connection, indirect connection, direct electrical connection or indirect electrical connection, but the present disclosure is not limited thereto. In addition, noticeably, the term "coupling" in the present disclosure refers to two elements being spaced apart from each other and there is no physical connection between the two elements, and an electric field energy generated by a current of one element induces electric field energy of another element.

Figure 10:
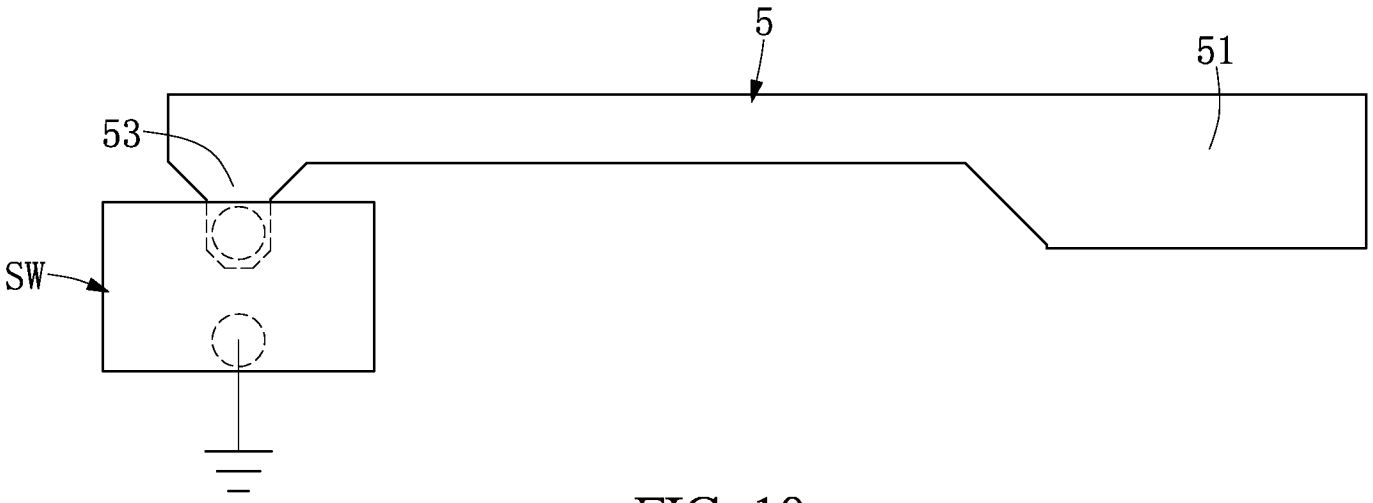
FIG. 10 illustrates a schematic diagram of a switch element in FIG. 7.

Reference is made to FIG. 7, in conjunction with FIG. 10. FIG. 10 illustrates a schematic diagram of the switch element SW in FIG. 7, in which FIG. 10 illustrates a circuit design of the switch element SW. In the present disclosure, the second radiation element 5 and the switch element SW are disposed on the second surface 22 of the substrate 2. However, in other embodiments, at least one of the second radiation element 5 and the switch element SW may be disposed on the first surface 21 of the substrate 2, such that at least one of the first radiation element 4, the second radiation element 5 and the switch element SW is disposed on a same surface of the substrate 2, but the present disclosure is not limited thereto. It should be noted that, in the present disclosure, the second radiation element 5 and the switch element SW may be disposed on a carrier substrate 8, and the carrier substrate 8 may be disposed on the substrate 2, such that the second radiation element 5 and the switch element SW may be disposed on the second surface 22 of the substrate 2 through the carrier substrate 8. For example, the carrier substrate 8 may be an FPCB (flexible printed circuit board), but the present disclosure is not limited thereto.

The switch element SW is coupled between the second radiation element 5 and the grounding metal element 3, the first radiation element 4 and the second radiation element 5 may form a first radiation pattern when the switch element SW is switched to a first mode, while the first radiation element 4 and the second radiation element 5 may form a second radiation pattern when the switch element SW is switched to a second mode, and the first radiation pattern is different from the second radiation pattern. In one embodiment of FIG. 11, the second radiation element 5 and the grounding metal element 3 (not shown in FIG. 11) are in a conducting state when the switch element SW is switched to the first mode, i.e., a pin SW3 may be selectively connected to pins SW4, SW5 or SW6; while the second radiation element 5 and the grounding metal element 3 are in a non-conducting state when the switch element SW is switched to the second mode, i.e., the pin SW3 is not connected to the pin SW4, SW5 or SW6. It should be noted that, in another embodiment, the second mode may refer to that the second radiation element 5 and the grounding metal element 3 being in a conducting state, but a conducting path corresponding to the first mode is different from the conducting path corresponding to the second mode. For example, the pin SW3 is connected to the pin SW5 in the first mode, while the pin SW3 is connected to the pin SW6 in the second mode. In other words, the conducting path or conducting state between the second radiation element 5 and the grounding metal element 3 may be controlled by the switch element SW to be turned on or off, such that operations of the first mode, the second mode or other modes may be defined according to practical requirements. With this structure, the present disclosure is able to adjust antenna radiation pattern by adjusting the conducting path or conducting state between the second radiation element 5 and the grounding metal element 3. Moreover, it should be noted that, in FIG. 6, the switch element SW may be controlled by a circuit board (not shown in FIG. 6) integrated in the mobile device U to perform mode switching for the switch element SW. In addition, it should be noted that, the carrier substrate 8 may include a grounding element 80, and in an exemplary example, an implementation of the present disclosure is to couple the switch element SW between the second radiation element 5 and the grounding element 80, couple the grounding element 80 to the conductive blocking element 9 (shown in FIG. 1), couple the conductive blocking element 9 to the ground metal layer 23, and couple the conductive blocking element 9 to the grounding metal element 3 through the ground metal layer 23. However, in other embodiments, at least one via hole may be formed in the carrier substrate 8, such that the grounding element 80 may be coupled to the ground metal layer 23 through the via hole, but the present disclosure is not limited thereto.

The second radiation element 5 may be coupled to the first radiation element 4, i.e., the second radiation element 5 may be coupled to at least one of the first feeding branch 41, the second feeding branch 42 and the third feeding branch 43. For example, in one embodiment, the vertical projection of the second radiation element 5 onto the metal housing 1 may partially overlap at least one of the vertical projections of the first feeding branch 41, the second feeding branch 42 and the third feeding branch 43 onto the metal housing 1, but the present disclosure is not limited thereto. Moreover, it should be noted that, in an exemplary example in this embodiment, the second radiation element 5 is disposed adjacent to the first feeding branch 41, however, in other embodiments, the second radiation element 5 may be disposed adjacent to the second feeding branch 42 or the third feeding branch 43, in order to adjust an amount of coupling effect that is induced between the second radiation element 5 and the first radiation element 4. However, it should be noted that, in a preferred embodiment, whether the second radiation element 5 is coupled to the first feeding branch 41, the second feeding branch 42 or the third feeding branch 43, the vertical projection of the second radiation element 5 onto the metal housing 1 at least partially overlaps the vertical projection of the slot 12 onto the metal housing 1. Namely, the second radiation element 5 is coupled to at least one of the first feeding branch 41, the second feeding branch 42 and the third feeding branch 43, and the vertical projection of the second radiation element 5 onto the metal housing 1 at least partially overlaps the vertical projection of the slot 12 onto the metal housing 1.

Reference is made to FIG. 7, in conjunction with FIG. 10, in FIG. 10, the second radiation element 5 includes a first body portion 51 and a connecting portion 53 connected to the first body portion 51, the connecting portion 53 is coupled to the switch element SW, such that the first body portion 51 is coupled to the switch element SW through the connecting portion 53. In addition, the first body portion 51 includes a fourth polygon substantially having a rectangular shape or an L-shape. One end of the first body portion 51 is coupled to the connecting portion 53, while another end of the first body portion 51 is an open end. The fourth polygon includes at least a long axis and a short axis, and the long axis of the fourth polygon is opposite to the connecting portion 53 and extends along the second direction. For example, in FIG. 7, the long axis of the fourth polygon may be a fourth dashed line passing through the open end and being parallel to the X axis. In addition, a width of the open end of the first body portion 51 that is adjacent to the first radiation element 4 may be greater than a width of the closed end of the first body portion 51, such that an amount of coupling effect that is induced between the second radiation element 5 and the first radiation element 4 may be adjusted by adjusting the width of the open end of the first body portion 51.

Figure 11:
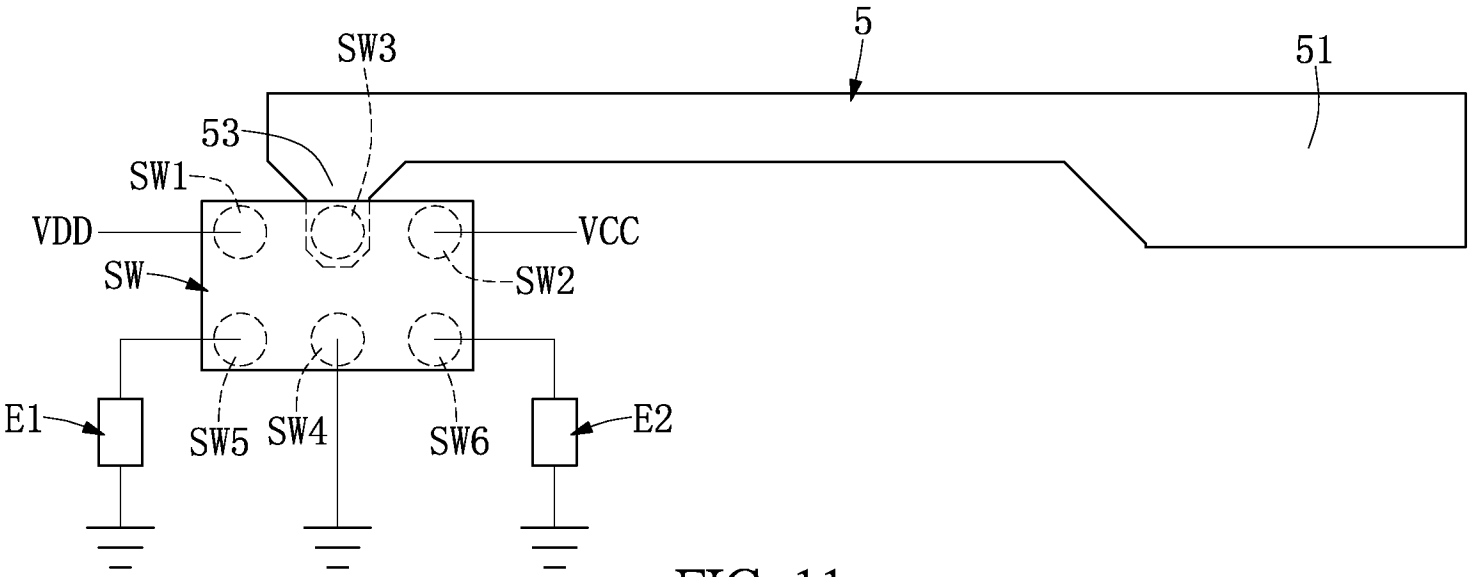
FIG. 11 illustrates a schematic diagram of another switch element utilized in the mobile device according to the first embodiment of the present disclosure.

Referring to FIG. 11, which is a schematic diagram of another switch element utilized in the mobile device according to the first embodiment of the present disclosure. As can be seen by comparing FIG. 11 with FIG. 10, in the embodiment of FIG. 11, a plurality of switching states of the switch element SW may be adjusted. In the embodiment of FIG. 11, the switch element SW includes six pins SW1, SW2, SW3, SW4, SW5 and SW6, the pin SW1 is coupled to a power source VDD, the pin SW2 is coupled to another power source VCC, such that the switch element SW is driven by the power sources VDD and VCC. In addition, the pin SW3 is coupled to the connecting portion 53 of the second radiation element 5, the pin SW4 is coupled to the grounding metal element 3, so that the pins SW3 and SW4 can be used to control the conducting and non-conducting states between the second radiation element 5 and the grounding metal element 3. In addition, the pin SW5 and the pin SW6 are coupled to the grounding metal element 3, and a first electronic element E1 is serially connected between the pin SW5 and the grounding metal element 3, and a second electronic element E2 is serially connected between the pin SW6 and the grounding metal element 3. For example, the first electronic element E1 and the second electronic element E2 may be resistors, inductors, capacitors or their combinations, thereby at least one of the impedance matching, the return loss and the radiation pattern of the mobile device U is adjusted according to characteristics of the first electronic element E1 and the second electronic element E2. However, It should be noted that, the design of the first electronic element E1 and the second electronic element E2 are not limited in the present disclosure.

In the embodiment of FIG. 11, the second radiation element 5 and the grounding metal element 3 are in a conducting state when the switch element SW is switched to the first mode, a direct conducting path between the second radiation element 5 and the grounding metal element 3 is made by the pin SW4, an indirect conducting path between the second radiation element 5 and the grounding metal element 3 is made by the pin SW5 and the serially connected first electronic element E1, or another indirect conducting path between the second radiation element 5 and the grounding metal element 3 is made by the pin SW6 and the serially connected second electronic element E2, thereby at least one of the return loss and the radiation pattern of the mobile device U is adjusted according to characteristics of the first electronic element E1 and the second electronic element E2.

Figure 12:
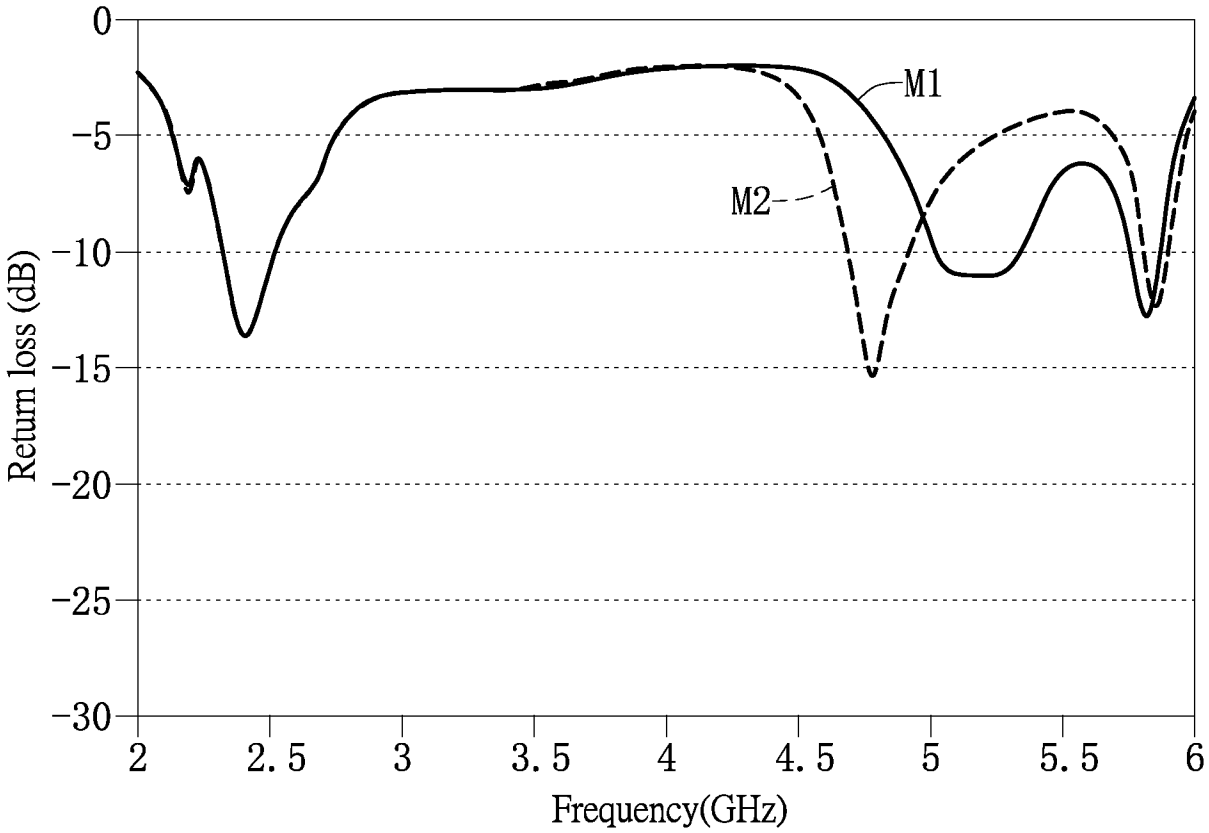
FIG. 12 illustrates a return loss according to the embodiment of FIG. 7.

Reference is made to FIG. 12, which illustrates a return loss according to the embodiment of FIG. 7. The second radiation element 5 and the grounding metal element 3 are in a conducting state when the switch element SW is switched to the first mode, therefore, a first curve M1 is obtained. The second radiation element 5 and the grounding metal element 3 are in a non-conducting state when switch element SW is switched to the second mode, therefore, a second curve M2 is obtained. Preferably, in the present disclosure, a center frequency of the second operating band corresponding to the first mode is different from a center frequency of the second operating band corresponding to the second mode. With this structure, the present disclosure is able to change the center frequency of the second operating band and the radiation pattern of the antenna structure through the switching operation of the switch element SW.

Second Embodiment

Figure 13:
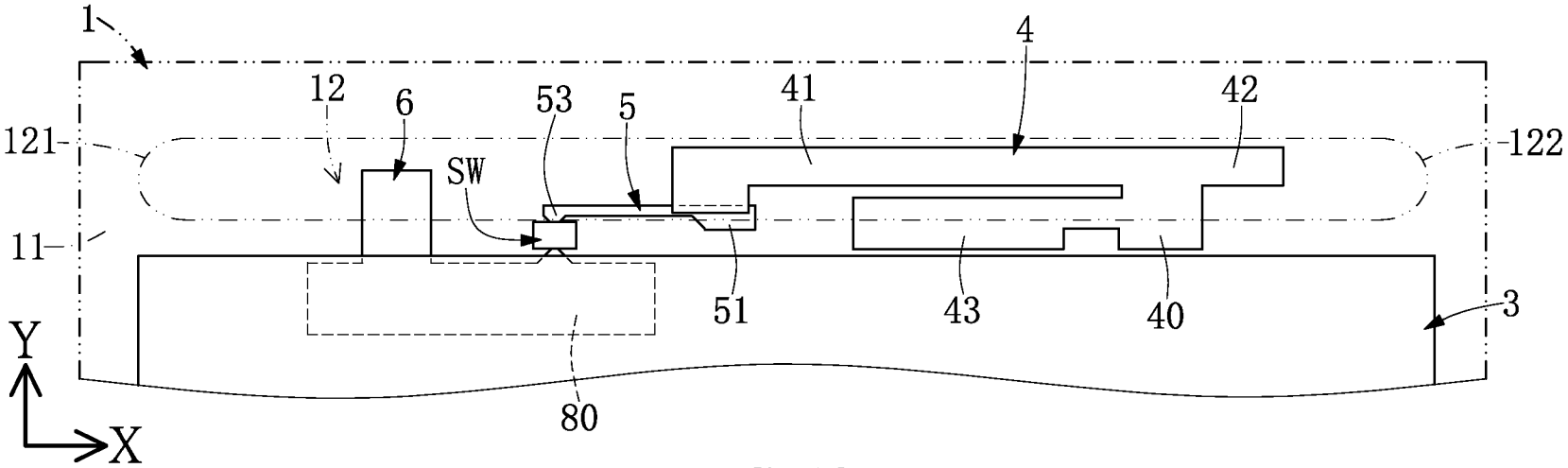
FIG. 13 illustrates a front view of a mobile device according to a second embodiment of the present disclosure.

Reference is made to FIG. 13, which illustrates a front view of a mobile device according to a second embodiment of the present disclosure. As can be seen by comparing FIG. 13 and FIG. 7, a difference between the second embodiment and the first embodiment is that, the mobile device U provided in the second embodiment further includes: a third radiation element 6. The third radiation element 6 is disposed on the substrate 2 and coupled to the grounding metal element 3. In the present disclosure, the third radiation element 6 is disposed on the second surface 22 of the substrate 2 as an example; however, in other embodiments, the third radiation element 6 may be disposed on the first surface 21 of the substrate 2, but the present disclosure is not limited thereto. In addition, it should be noted that, in the present disclosure, the third radiation element 6 is coupled to the grounding element 80 of the carrier substrate 8, thereby the ground metal layer 23 (not shown in FIG. 13) is indirectly coupled to the grounding metal element 3 through the grounding element 80. Further, it should be noted that, other detailed structures of the mobile device U provided in the second embodiment are similar to the structure in the abovementioned first embodiment, which is not reiterated herein.

A vertical projection of the third radiation element 6 onto the metal housing 1 extends from the grounding metal element 3 toward the slot 12. In other words, the third radiation element 6 may directly extend from the grounding metal element 3, and extends along a direction from the grounding metal element 3 toward the slot 12. In addition, the vertical projection of the third radiation element 6 onto the metal housing 1 at least partially overlaps the vertical projection of the slot 12 onto the metal housing 1, however, in other embodiments, the vertical projection of the third radiation element 6 onto the metal housing 1 may be not overlap the vertical projection of the slot 12 onto the metal housing 1.

Further, the third radiation element 6 is disposed adjacent to the first feeding branch 41 or the third feeding branch 43 so as to be coupled to the first feeding branch 41 or the third feeding branch 43. It should be noted that, in the present disclosure, the third radiation element 6 is disposed adjacent to the first feeding branch 41 and the third feeding branch 43 as an example, but the present disclosure is not limited thereto. With this structure, an amount of coupling effect induced between the third radiation element 6 and the first feeding branch 41 and third feeding branch 43 may be adjusted, so as to adjust at least one of the impedance matching, the radiation pattern and the gain of the mobile device U. Preferably, the impedance matching of the second operating band ranging from 5150 MHz to 5875 MHz may be adjusted with the structure of FIG. 13.

Figure 14:
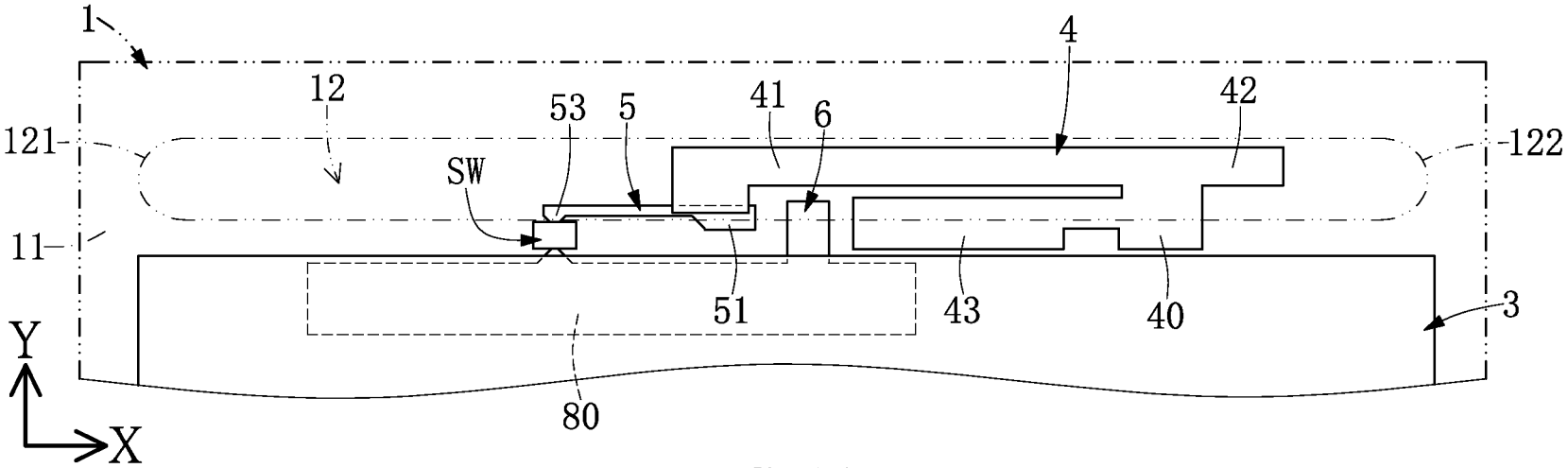
FIG. 14 illustrates another front view of the mobile device according to the second embodiment of the present disclosure.

Reference is made to FIG. 14, which illustrates another front view of the mobile device according to the second embodiment of the present disclosure. As can be seen by comparing FIG. 14 with FIG. 13, a difference between FIG. 14 and FIG. 13 is that, in the embodiment of FIG. 14, a location of the third radiation element 6 may be adjusted, so as to adjust an amount of coupling effect induced between the third radiation element 6 and the first radiation element 4.

Third Embodiment

Figure 15:
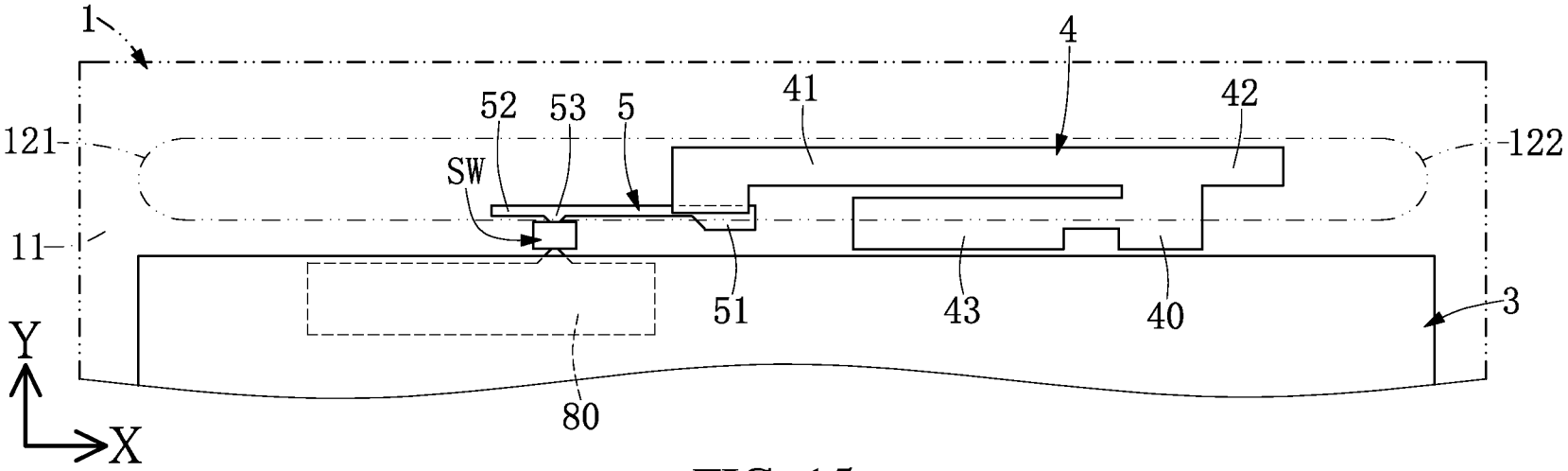
FIG. 15 illustrates a front view of a mobile device according to a third embodiment of the present disclosure.

Reference is made to FIG. 15, which illustrates a front view of a mobile device according to a third embodiment of the present disclosure. As can be seen by comparing FIG. 15 with FIG. 7, a difference between the third embodiment and the first embodiment is that, the second radiation element 5 of mobile device U provided in the third embodiment further includes a second body portion 52. In detail, as shown in FIG. 15, the second radiation element 5 includes a first body portion 51, a second body portion 52 and a connecting portion 53 connected between the first body portion 51 and the second body portion 52, and the connecting portion 53 is coupled to the switch element SW. Therefore, a T-shaped structure is formed, and the impedance matching of the antenna structure may be adjusted by adjusting at least one of the shape and the location of the second radiation element 5. Further, it should be noted that, other detailed structures of the mobile device U provided in the third embodiment are similar to the structure in the abovementioned first embodiment, which is not reiterated herein.

The first body portion 51 includes a fourth polygon substantially having a rectangular shape or an L-shape. One end of the first body portion 51 is coupled to the connecting portion 53, while another end of the first body portion 51 is an open end. The fourth polygon includes at least a long axis and a short axis, and the long axis of the fourth polygon extends along the second direction. For example, the long axis of the fourth polygon may be a fourth dashed line passing through the open end and parallel to the X axis. In addition, the second body portion 52 includes a fifth polygon substantially having a rectangular shape or an L-shape. One end of the second body portion 52 is coupled to the connecting portion 53, while another end of the first body portion 51 is an open end. The fifth polygon includes at least a long axis and a short axis, and the long axis of the fifth polygon extends along the first direction. For example, the long axis of the fifth polygon may be a fifth dashed line passing through the open end and parallel to the X axis. Therefore, the antenna structure may be adjusted by adjusting at least one of the shape and the location of the first body portion 51 and second body portion 52.

Fourth Embodiment

Figure 16:
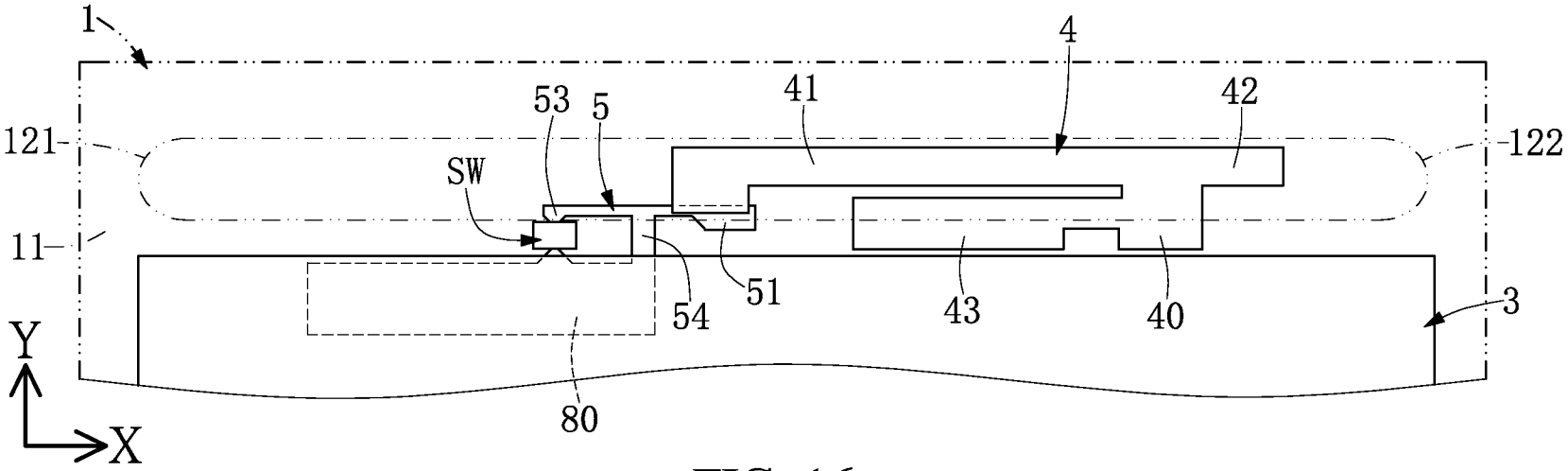
FIG. 16 illustrates a front view of a mobile device according to a fourth embodiment of the present disclosure.

Reference is made to FIG. 16, which illustrates a front view of a mobile device according to a fourth embodiment of the present disclosure. As can be seen by comparing FIG. 16 and FIG. 7, a difference between the fourth embodiment and first embodiment is that, the second radiation element 5 further includes a grounding portion 54, with this structure, the connecting portion 53 and the grounding portion 54 of the second radiation element 5 are simultaneously coupled to grounding metal element 3 when the switch element SW is switched to the first mode, thereby the second radiation element 5 operates as a planar inverted-F antenna (PIFA), and the impedance matching of the antenna structure may be adjusted by adjusting at least one of the shape and the location of the second radiation element 5. Further, it should be noted that, other detailed structures of the mobile device U provided in the fourth embodiment are similar to the structure in the abovementioned first embodiment, which is not reiterated herein.

In detail, the second radiation element 5 includes a first body portion 51, a connecting portion 53 connected to the first body portion 51 and a grounding portion 54 connected to the first body portion 51. The connecting portion 53 is coupled to the switch element SW, and the grounding portion 54 is coupled to the grounding metal element 3. In addition, in one embodiment, the grounding portion 54 is coupled between the second radiation element 5 and the grounding element 80, and the grounding element 80 is coupled to at least one of the ground metal layer 23 and the conductive blocking element 9, and the grounding portion 54 is coupled to the grounding metal element 3 through at least one of the ground metal layer 23 (not shown in FIG. 16) and the conductive blocking element 9. In addition, It should be noted that, in the present disclosure, a distance between the grounding portion 54 of the second radiation element 5 and the first radiation element 4 is shorter than a distance between the connecting portion 53 and the first radiation element 4.

Advantageous Effects of the Embodiment

An effect of the present disclosure is that the mobile device U provided in the present disclosure utilizes technical solutions of "coupling the switch element SW between the second radiation element 5 and the grounding metal element 3" and "the first radiation element 4 and second radiation element 5 forming a first radiation pattern when the switch element SW is switched to a first mode, and the first radiation element 4 and the second radiation element 5 forming a second radiation pattern when the switch element SW is switched to a second mode" to adjust at least one of the return loss and the radiation pattern of the antenna structure of the mobile device U.

In conclusion, an operating system of the mobile device U may switch any modes of the switch element SW according to practical requirements, in order to provide a better communication quality. With this structure, the antenna structure integrated in the mobile device U in the present disclosure may be regarded as a smart antenna structure.

However, the aforementioned description for the mobile device of the first to fourth embodiments are merely examples and are not meant to limit the scope of the present disclosure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A mobile device, comprising:

a metal housing including a body portion and a slot disposed on the body portion;

a substrate disposed on the metal housing;

a grounding metal element disposed on the substrate, and coupled to the metal housing;

a first radiation element including a feeding portion, and the first radiation element includes a first feeding branch, a second feeding branch and a third feeding branch, wherein a vertical projection of the first radiation element onto the metal housing at least partially overlaps a vertical projection of the slot, wherein an end of the first feeding branch is coupled to the feeding portion, and the first feeding branch includes a first polygon, the first polygon including at least a long axis and a short axis, and the long axis of the first polygon extending along a first direction, wherein an end of the second feeding branch is coupled to the feeding portion, and the second feeding branch includes a second polygon, the second polygon including at least a long axis and a short axis, the long axis of the second polygon extending along a second direction, and the second direction being opposite to the first direction, and wherein an end of the third feeding branch is coupled to the feeding portion, and the third feeding branch includes a third polygon, the third polygon including at least a long axis and a short axis, and the long axis of the third polygon extending along the first direction;

a second radiation element disposed on the substrate, a vertical projection of the second radiation element onto the metal housing at least partially overlaps the vertical projection of the slot; and a switch element disposed on the substrate, and coupled between the second radiation element and the grounding metal element, wherein a first radiation pattern is generated by the first radiation element and the second radiation element when the switch element is switched to a first mode in which refers to the second radiation element and the grounding metal element are in a conducting state, and a second radiation pattern is generated by the first radiation element and the second radiation element when the switch element is switched to a second mode in which refers to the second radiation element and the grounding metal element are in a non-conducting state.

2. The mobile device of claim 1, wherein the second radiation element is coupled to the first feeding branch, the second feeding branch or the third feeding branch.

3. The mobile device of claim 1, further comprising:

a third radiation element disposed on the substrate and coupled to the grounding metal element, wherein a vertical projection of the third radiation element onto the metal housing at least partially overlaps the vertical projection of the slot.

4. The mobile device of claim 3, wherein the third radiation element is disposed adjacent to the first feeding branch or the third feeding branch to be coupled with the first feeding branch or the third feeding branch.

5. The mobile device of claim 1, wherein the second radiation element includes a first body portion, a second body portion and a connecting portion connected between the first body portion and the second body portion, and the connecting portion is coupled to the switch element; wherein the first body portion includes a fourth polygon, the fourth polygon includes at least a long axis and a short axis, and the long axis of the fourth polygon extends along the second direction, and wherein the second body portion includes a fifth polygon, the fifth polygon includes at least a long axis and a short axis, and the long axis of the fifth polygon extends along the first direction.

6. The mobile device of claim 1, wherein the second radiation element includes a first body portion, a grounding portion connected to a connecting portion of the first body portion, and a grounding portion connected to the first body portion, the connecting portion being coupled to the switch element, and the grounding portion being coupled to the grounding metal element.

7. The mobile device of claim 1, wherein the mobile device is able to operate in a first operating band and a second operating band, and a center frequency of the second operating band that is generated when the switch element is switched to the first mode is different from another center frequency of the second operating band that is generated when the switch element is switched to the second mode.

8. The mobile device of claim 1, further includes a conductive element that is disposed on the substrate and coupled to the grounding metal element, wherein the conductive element forms a U-shaped vertical projection onto the metal housing, and the vertical projections of the first radiation element and the second radiation element onto the metal housing overlaps within the U-shaped vertical projection onto the metal housing.

9. The mobile device of claim 8, wherein the conductive element is a conductive sponge.

10. The mobile device of claim 1, further comprising:

a feeding element coupled between the feeding portion of the first radiation element and the grounding metal element, wherein the feeding element includes a feeding end and a grounding end, the feeding end is coupled to the feeding portion of the first radiation element, and the grounding end is coupled to the grounding metal element.

11. The mobile device of claim 1, wherein a first coupling gap is formed between the first feeding branch and the third feeding branch, and a width of the first coupling gap is smaller than or equal to a width of the slot.

12. An antenna structure, disposed on a metal housing having a slot, the antenna structure comprising:

a grounding metal element coupled to the metal housing;

a first radiation element including a feeding portion, and the first radiation element includes a first feeding branch, a second feeding branch and a third feeding branch, wherein a vertical projection of the first radiation element onto the metal housing at least partially overlaps a vertical projection of the slot, wherein an end of the first feeding branch is coupled to the feeding portion, and the first feeding branch includes a first polygon, the first polygon including at least a long axis and a short axis, and the long axis of the first polygon extending along a first direction, wherein an end of the second feeding branch is coupled to the feeding portion, and the second feeding branch includes a second polygon, the second polygon including at least a long axis and a short axis, the long axis of the second polygon extending along a second direction, and the second direction being opposite to the first direction, and wherein an end of the third feeding branch is coupled to the feeding portion, and the third feeding branch includes a third polygon, the third polygon including at least a long axis and a short axis, and the long axis of the third polygon extending along the first direction;

a second radiation element, wherein a vertical projection of the second radiation element onto the metal housing at least partially overlaps the vertical projection of the slot; and a switch element coupled between the second radiation element and the grounding metal element, wherein a first radiation pattern is generated by the first radiation element and the second radiation element when the switch element is switched to a first mode in which refers to the second radiation element and the grounding metal element are in a conducting state, and a second radiation pattern is generated by the first radiation element and the second radiation element when the switch element is switched to a second mode in which refers to the second radiation element and the grounding metal element are in a non-conducting state.

13. The antenna structure of claim 12, wherein the second radiation element is coupled to the first feeding branch, the second feeding branch or the third feeding branch.

14. The antenna structure of claim 12, wherein the second radiation element includes a first body portion, a second body portion and a connecting portion connected between the first body portion and the second body portion, and the connecting portion is coupled to the switch element; wherein the first body portion includes a fourth polygon, the fourth polygon includes at least a long axis and a short axis, and the long axis of the fourth polygon extends along the second direction, and wherein the second body portion includes a fifth polygon, the fifth polygon includes at least a long axis and a short axis, and the long axis of the fifth polygon extends along the first direction.

15. The antenna structure of claim 12, wherein the second radiation element includes a first body portion, a grounding portion connected to a connecting portion of the first body portion, and a grounding portion connected to the first body portion, the connecting portion being coupled to the switch element, and the grounding portion being coupled to the grounding metal element.

16. The antenna structure of claim 12, wherein the antenna structure is able to operate in a first operating band and a second operating band, and a center frequency of the second operating band that is generated when the switch element is switched to the first mode is different from another center frequency of the second operating band that is generated when the switch element is switched to the second mode.

17. The antenna structure of claim 12, wherein a first coupling gap is formed between the first feeding branch and the third feeding branch, and a width of the first coupling gap is smaller than or equal to a width of the slot.

* * * * *